US006193578B1

(12) United States Patent
Weber

(10) Patent No.: US 6,193,578 B1
(45) Date of Patent: Feb. 27, 2001

(54) BUBBLING BRAIN NOVELTY

(76) Inventor: Thomas Carl Weber, 11 Deborah Dr., Morris Township, NJ (US) 07960

( * ) Notice: Subject to any disclaimer, the term of this patent is extended or adjusted under 35 U.S.C. 154(b) by 0 days.

(21) Appl. No.: 09/426,057

(22) Filed: Oct. 22, 1999

(51) Int. Cl.[7] ..... A63H 23/08
(52) U.S. Cl. ..... 446/267; 446/15
(58) Field of Search ..... 446/267, 210, 446/15; 40/406; D30/102, 103, 104, 106, 107; 472/61, 67, 70, 75, 81, 82

(56) References Cited

U.S. PATENT DOCUMENTS

| | | | | |
|---|---|---|---|---|
| D. 55,754 | * | 7/1920 | Crowell | D30/101 |
| D. 75,081 | * | 5/1928 | Tauaman | D30/101 |
| 3,009,286 | * | 11/1961 | Warner | 446/267 |
| 4,939,859 | * | 7/1990 | Bradt | 40/406 |
| 5,017,171 | * | 5/1991 | Shiina | 446/267 |
| 5,211,469 | * | 5/1993 | Matthias et al. | 362/101 |
| 5,272,604 | * | 12/1993 | Lin | 40/409 |
| 5,279,512 | | 1/1994 | Manale . | |
| 5,292,564 | * | 3/1994 | Lee | 428/13 |
| 5,313,727 | | 5/1994 | Murray, Jr. . | |
| 5,349,771 | * | 9/1994 | Burnett | 40/406 |
| 5,416,994 | * | 5/1995 | McLaughlin | 40/406 |
| 5,476,068 | * | 12/1995 | Townsend | 40/406 |
| 5,603,176 | | 2/1997 | Eddins et al. . | |
| 5,816,884 | | 10/1998 | Chang . | |
| 5,921,841 | * | 7/1999 | Coleman et al. | 446/267 |

* cited by examiner

*Primary Examiner*—Jacob K. Ackun
*Assistant Examiner*—Kurt Fernstrom
(74) *Attorney, Agent, or Firm*—Gene Scott-Patent Law & Venture Group

(57) ABSTRACT

A transparent vessel containing a fluid and a life-like full scale human brain inserted into the fluid is used for novelty purposes. The vessel is open on its top and sealed on its bottom, and is mounted on a base portion of the device. Air bubbles are produced from an air pump attached to the side of the base portion. A tube connected to the air pump and an outlet port is positioned inside of the vessel, immersed in the liquid to supply air. The transparent, water-tight brain vessel is lit from underneath by a lamp. To enhance an effect of a scientific fiction experiment, the novelty is placed on a stand and has one or more decorative perforated tubes attached for visual effect. The tank is preferably covered with a dome-shaped lid.

2 Claims, 1 Drawing Sheet

BUBBLING BRAIN NOVELTY

BACKGROUND OF THE INVENTION

1. Field of the Invention

This invention relates generally to novelties and items of general interest, and more particularly, to such novelties representing a science fiction experiment.

2. Description of Related Art

The following art defines the present state of this field:

Shiina, U.S. Pat. No. 5,017,171 describes a toy utilizing bubbles in liquid comprising a vessel to be charged with a liquid keeping an air layer at the top and to be sealed, a bubble generating member, and in-liquid movable members moved by bubbles rising in the liquid in the vessel.

Manale, U.S. Pat. No. 5,279,512 describes a toy water wheel including a transparent water-tight container, a rotatable wheel connected to the interior of the container, and electric pump for pumping water to and from the container, a nozzle connected to the container for directing water to the wheel to turn the wheel, a first hose connected to the electric pump and the nozzle for conveying water to the nozzle, and a second hose connected to the container and to the pump for conveying water from the container to the pump.

Murray, Jr., U.S. Pat. No. 5,313,727 describes a decorative kinetic device which includes a transparent hollow dome containing a fluid and a plurality of small particles. The dome is open on its bottom and is mounted on a base having a pumping chamber formed therein. The top of the pumping chamber, which serves as the bottom of the dome, includes an intake hole and an outlet hole to provide flow paths between the dome and the pumping chamber. A pump impeller is positioned within the pumping chamber to circulate the fluid and the particles, the impeller being rotated by a motor positioned in the base below the pumping chamber. An extension member is attached to and extends vertically upward from the pump impeller into the dome and is adapted to receive a decorative object. A transport tube having an intake port and an outlet port is positioned in the dome such that the intake port is connected to the outlet hole of the pumping chamber and the outlet port of the transporting tube is positioned near the top of the dome. Rotation of the impeller causes the fluid and the particles to be drawn through and out of the pumping chamber into and through the transport tube, out of the transport tube near the top of the dome and down through the dome to the pumping chamber again. Simultaneously, the rotating extension member is caused to rotate.

McLaughlin, U.S. Pat. No. 5,416,994 describes a liquid display device comprising an elongated, transparent, cylindrical display tube containing a column of liquid and including a light-transmitting base. A pedestal supports the display tube and includes a light-transmitting top plate on which the base of the display tube is seated. An impeller within the display tube rotates the liquid within the tube. The pedestal contains a reversible motor for driving the impeller, lights for lighting the contents of the display tube through the light-transmitting base and top plate, and air pumps for forcing air into the liquid within the display tube. A series of timers controls the operation of the motor, air pump and lights to create continuously changing turbulence patterns in the liquid.

Eddins et al., U.S. Pat. No. 5,603,176 describes a simulated suspended animation biosphere assembly including an outer housing having a transparent wall portion, a transparent gel in the housing and at least one action component movably suspended in the gel. The action component is adapted to resemble and actual action element which is capable of voluntary controlled independent action movement and which is movably suspendable in a natural environmental medium, Chang, U.S. Pat. No. 5,816,884 describes a music box having a water pump structure, especially to a music box in combination with a water pump, including a music box, a water pump, and a regulating valve wherein the music box is provided with a linking member by which the water r pump is connected with the music box. The linking m ember is associated with a water pressure plate of the water pump and the movement of the linking member triggered off by the music box will activate the water pressure plate to move back and forth. The to-and-fro movement of the water pressure plate will in turn generate a pressure, forcing water to circulate in and out of two main bodies of the water pump. In addition, the regulating valve having one-dimensional water influx and discharging valves is adapted to regulate the water circulation in one direction. Ornamental articles such as a crystal ball can be further attached to the present invention whereby music is given sweetly out by the music box while the water current is lively circulate d in and out of the water pump simultaneously.

The prior art teaches various novelty devices and apparatus utilizing bubbles or other objects floating in a fluid which are interesting for their movement , color, and general unusual effects. However, the prior art does not teach that such a novelty may be constructed so as to a dvantageously produce a scientific fiction effect enhanced by the sound and visual effect of bubbling water. The present invention fulfills these needs and provides further related advantages as described in the following summary.

SUMMARY OF THE INVENTION

The present invention teaches certain benefits in construction and use which give rise to the objectives described below.

The present invention teaches a novelty which includes a transparent vessel containing a fluid and a life-like full scale human brain inserted into the fluid. The vessel is open on its top and sealed on its bottom, and is mounted on a base section of the device. Air bubbles are produced from an air pump attached to the side of the base section. A tube having an intake port connected to the air pump and an outlet port positioned inside of the vessel is immersed in the liquid to supply air. The transparent, water-tight brain vessel is lit from underneath by a lamp. To enhance a science fiction visual effect, the novelty includes a stand, has a decorative perforated tubing attached to the base and to the side of the vessel, and is covered with a dome-shaped lid.

A primary objective of the present invention is to provide a bubbling brain novelty having advantages not taught by the prior art.

Another objective is to use such a novelty for amusement purposes to produce soothing bubbling sounds.

A further objective is to use a novelty as a fish tank.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the present invention. In this drawing.

DETAILED DESCRIPTION OF THE INVENTION

Figure 1:
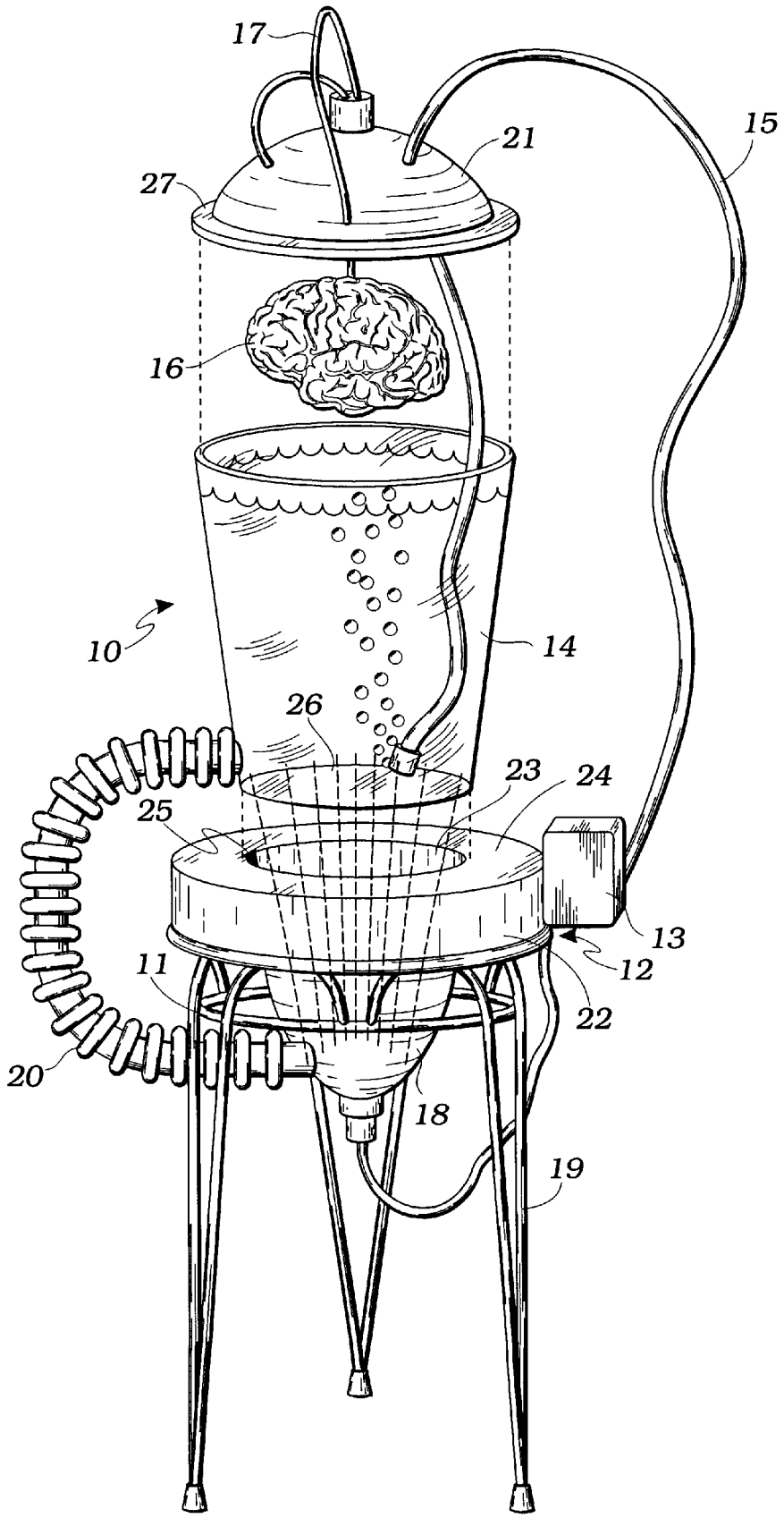
FIG. 1 is a perspective view of the preferred embodiment of the present invention.

The above-described drawing figures illustrate the invention, a novelty apparatus 10. FIG. 1 is a perspective view illustrating the present invention. The apparatus 10 comprises a stand 11 providing a tank support base 12 made of wood, steel, aluminum, plastic or other structural material, and an air pump 13. The base 12 includes an outer 22 and an inner 23 concentric annular skirts which are connected by a horizontal top annular surface 24. Horizontal top annular surface 24 extends inwardly from the outer skirt 22 to the inner skirt 23 and forms with the inner skirt 23 an opening 25 in the center of the base 12. A transparent water tank 14 is received by the opening 25 formed by the inner annular skirt 23 of the base 12 and is positioned for viewing an interior of the water tank 14. The water tank 14, made of glass or plastic, has an open top and a closed bottom and is filled with water. Alternatively, the water tank 14 is filled with other clear or colored fluid. The air pump 13 is supported by the outer annular skirt 22 of the base 12 and is attached to the outer annular skirt by a suitable means, such as a screw or any other fastening means. An air hose 15, engaged with the air pump 13, delivers air into the transparent water tank 14 to create a continuous bubbling effect. A replica of a human brain 16 made of rubber, plastic or other suitable material is positioned within the water tank 14 through the open top thereof and is supported therein by a brain supporting means, such as plastic tubing 17 to suggest the appearance of a science fiction experiment. A lamp enclosure 18 made of steel, aluminum, plastic or other structural material, is engaged with the tank support base 12 and positioned to direct a light beam 26 through opening 25 into the water tank 14 for creating a lighting effect therein. The light beam 26 is produced by various lighting means suitable for such effect when placed within the lamp enclosure 18.

The combination of the tank support base 12, air pumpl3, water tank 14, air hose 15, brain replica 16, and lamp enclosure 18 creates an amusement effect suggesting the appearance of a science fiction experiment. Additionally, it may have a soothing effect from bubbling sounds and the view of the moving water. The water tank may also be used as a fish tank.

Additionally, the invention to additionally includes a set of legs 19 for mounting the water tank base 12 and for supporting it in an elevated position.

Additionally, the invention further comprises a flexible hose 20 extending from an exterior surface 22 of the lamp enclosure 23 to an exterior surface 24 of the water tank 14 for further suggesting a science fiction experiment.

The invention further includes a dome shaped water tank cover 21 adapted for covering the open top 27 of the water tank 14 for aesthetic purposes, to direct and support the various tubes of the invention, and to enhance the appearance of the invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising:

a stand providing a torus shaped tank support base, and an air pump;

a transparent water tank filled with water and engaged with the tank support base so as to be positioned for viewing the water;

a dome shaped water tank cover adapted for covering an open top of the water tank;

an air hose engaged with the air pump, the air hose extending from the air pump, exteriorly to the water tank cover and into the water tank through the water tank cover, and terminating near a bottom of the water tank, for delivery of air into the water tank as air bubbles;

a replica of a human brain positioned medially within the water tank and supported therein by a brain supporting means comprising at least one tube extending from the water tank cover downwardly to the brain replica;

a lamp enclosure engaged below the tank support base and positioned for directing a light beam through the torus shaped tank support base and into the water tank for producing a lighting effect therein; and a flexible, bellows-shaped hose extending from an exterior surface of the lamp enclosure exteriorly to an exterior surface of the water tank;

whereby the tank support base, air pump, water tank, water tank cover, air hose, brain replica, bellows-shaped hose and lamp enclosure suggest the appearance of a science fiction experiment.

2. The apparatus of claim 1 further comprising a set of legs for mounting the tank support base in an elevated position.

* * * * *